US005127384A

United States Patent [19]

Geringer

[11] Patent Number: 5,127,384

[45] Date of Patent: Jul. 7, 1992

[54] METHOD AND APPARATUS FOR REGULATING THE MIXTURE OF FUEL QUANTITY FED TO THE CYLINDERS OF AN INTERNAL COMBUSTION ENGINE

[75] Inventor: Bernhard Geringer, Deizisau, Fed. Rep. of Germany

[73] Assignee: Mercedes-Benz AG, Fed. Rep. of Germany

[21] Appl. No.: 737,475

[22] Filed: Jul. 30, 1991

[30] Foreign Application Priority Data

Aug. 1, 1990 [DE] Fed. Rep. of Germany ..... 4024369

[51] Int. Cl.[5] ..... F02M 51/00

[52] U.S. Cl. ..... 123/494

[58] Field of Search ..... 123/494, 90.11, 90.15, 123/188 R, 188 AA

[56] References Cited

U.S. PATENT DOCUMENTS

| | | | |
|---|---|---|---|
| 4,217,863 | 8/1980 | Ezoe | 123/494 |
| 4,280,465 | 7/1981 | Staerzl | 123/494 |
| 4,762,108 | 8/1988 | de Concini | 123/494 |
| 4,788,960 | 12/1988 | Oshizawa | 123/494 |
| 4,793,313 | 12/1988 | Paganon et al. | 123/494 |
| 4,844,035 | 7/1989 | Takagi | 123/494 |
| 4,942,851 | 7/1990 | Kawamura | 123/90.11 |

FOREIGN PATENT DOCUMENTS

| | | | |
|---|---|---|---|
| 3426799 | 1/1986 | Fed. Rep. of Germany | 123/90.11 |
| 3617329 | 11/1986 | Fed. Rep. of Germany | 123/90.11 |
| 3831663 | 3/1990 | Fed. Rep. of Germany | 123/90.11 |

*Primary Examiner*—Raymond A. Nelli

*Attorney, Agent, or Firm*—Evenson, Wands, Edwards, Lenahan & McKeown

[57] ABSTRACT

A method for regulating the mixture or fuel quantity fed to the cylinders of an internal combustion engine uses an arrangement for the variable metering of the mixture or fuel quantity to the cylinders of the internal combustion engine, a device for acquiring the actual value of the mixture or fuel quantity fed in, by means of measuring the stroke of a valve device, arranged movably in the metering arrangement, and an arrangement for regulating the valve movement. In order to be able to determine the actual value of the metered quantity with great accuracy where simple and cheap sensors are used, the stroke duration of the valve device allocated to each cylinder is determined with a position sensor and regulated to an identical value for all of the valve devices.

7 Claims, 1 Drawing Sheet

METHOD AND APPARATUS FOR REGULATING THE MIXTURE OF FUEL QUANTITY FED TO THE CYLINDERS OF AN INTERNAL COMBUSTION ENGINE

BACKGROUND AND SUMMARY OF THE INVENTION

The present invention relates to a method and apparatus for regulating the mixture or fuel quantity fed to the cylinders of an internal combustion engine using an arrangement for the variable metering of the mixture or fuel quantity to the cylinders of the internal combustion engine, a device for acquiring the actual value of the mixture or fuel quantity to be fed in, by means of measuring the stroke of a valve means that are arrange movably in the metering arrangement, and an arrangement for regulating the valve movement.

German Patent Document 3,831,663 discloses a fuel injection system for internal combustion engines in which the actual value of the fuel supply to the cylinders of the internal combustion engine is acquired via a measurement of the stroke movement of a valve means in a metering arrangement. The fuel quantity to be fed in is determined in a control unit as a function of engine parameters, taking into account the actual value, and is transmitted to the metering arrangement as an actuating signal.

Particularly in the idling mode of an internal combustion engine, i.e. at low loads and speeds, differences between individual cylinders as regards their filling or injection quantity are clearly perceptible. In order to compensate for these differences by an individual regulation, very high requirements are set for the accuracy of this regulation. The acquisition of the stroke or of the stroke characteristic of the valve means for actual value determination is, in particular, very expensive and yet cannot be accomplished with sufficient precision in production engines.

An object of the present invention is to improve a regulation facility of the above-described type for mixture or fuel-quantity metering in such a way that the actual value of the metered quantity can be determined with great accuracy where simple and cheap sensors are used.

This and other objects are achieved by the present invention which provides a method for regulating the mixture or fuel quantity fed to cylinders of an internal combustion engine that has an arrangement for the variable metering of the mixture or fuel quantity to the cylinders of the internal combustion engine, means of measuring a stroke of valve means that are arranged movably in the metering arrangement, and an arrangement for regulating the valve movement. The method of the present invention includes the steps of: measuring of a stroke of the valve means allocated to each cylinder to acquire an actual value of the mixture or fuel quantity fed in; determining a stroke duration of the valve means allocated to each cylinder; and regulating the stroke duration to an identical value for all valve means.

The objects of the invention are also achieved by a device constructed in accordance with an embodiment of the present invention which provides a device for regulating the mixture or fuel quantity fed to cylinders of an internal combustion engine. The device includes a metering arrangement for the variable metering of the mixture or fuel quantity to the cylinders of the internal combustion engine, valve means arranged movably in the metering arrangement, means for measuring a stroke of the valve means allocated to each cylinder to acquire an actual value of the mixture or fuel quantity fed in, an arrangement for regulating the movement of the valve means, means for determining a stroke duration of the valve means allocated to each cylinder, and means for regulating the stroke duration to an identical value for all valve means. The means for measuring a stroke of the valve means includes a position sensor for each valve means, this position sensor providing as an output to the means for determining a stroke duration a signal when a stroke of the valve means is overshot or undershot.

To acquire the actual value of the mixture quantity (in the case of mixture-compressing internal combustion engines) or of the fuel quantity (in the case of air-compressing internal combustion engines) fed to each cylinder, the duration of the stroke of the valve means provided in the metering arrangement is measured. For this purpose, the overshooting of a particular stroke threshold value of the valve means is detected by means of a position sensor. The duration between the overshooting of this threshold value and the subsequent undershooting of the threshold value upon closure of the valve means, i.e., the stroke duration, is a measure of the actual value of the mixture or fuel quantity fed in. This actual value is acquired for all the cylinders of the internal combustion engine and, to compensate for differences in the filling or injection quantity of each cylinder, is regulated by corresponding actuation of the valve means to an identical value for all the cylinders of the internal combustion engine.

Other objects, advantages and novel features of the present invention will become apparent from the following detailed description of the invention when considered in conjunction with the accompanying drawings.

DETAILED DESCRIPTION OF THE DRAWINGS

Figure 1:
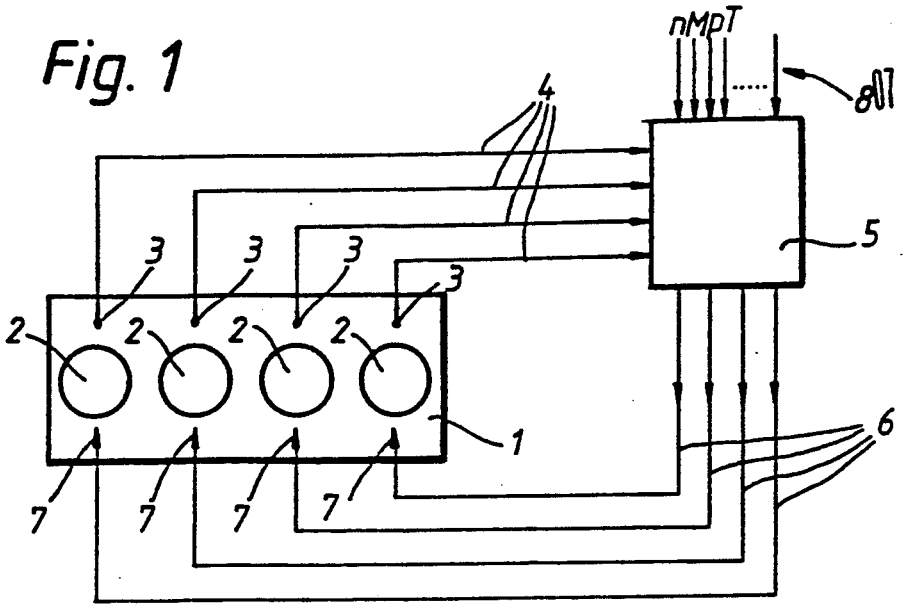
FIG. 1 shows schematically the structure of a regulating circuit, using a 4-cylinder internal combustion engine as an example, constructed in accordance with an embodiment of the present invention.

A regulating circuit is depicted schematically in FIG. 1, using a four-cylinder internal combustion engine as an example. The internal combustion engine denoted by 1 is of course not limited to a particular number of cylinders 2 but can have any number. Allocated to each cylinder 2 is a position sensor 3, which outputs a signal to the regulating electronics 5 via lines 4 whenever the stroke of that valve means (not depicted here for the sake of simplicity) of the mixture or fuel metering arrangement which is allocated to the respective cylinder overshoots and then undershoots a particular value. The stroke duration is determined from the time difference of the two signals (overshooting and undershooting) of each cylinder. With the aid of the regulating electronics 5, the actual values of the stroke duration and hence of the filling or fuel quantity of each cylinder are evaluated and the stroke duration is regulated to an identical value for all the cylinders 2 of the internal combustion engine For this purpose, the drive signals determined in the regulating electronics pass via lines 6 to the actuating elements 7 allocated to the individual cylinders 2, these actuating elements effecting individual regulation of the filling or fuel quantity for each cylinder. In this way, a desired equalization of all the cylinders of the internal combustion engine can be achieved.

In the case of a mixture-compressing internal combustion engine, the valve means of the (mixture) metering arrangement are the inlet valves allocated to each cylinder. Arranged at each of the inlet valves is a position sensor 3 which outputs a signal whenever the valve overshoots and undershoots a particular stroke value. This threshold value for the stroke can be freely chosen but is preferably just above the run-up 11 and run-down ramp 12, respectively, of the stroke characteristic of the valve. These valves can be controlled individually via the actuating elements 7, for example in the form of a solenoid valve control.

In an air-compressing internal combustion engine, in which the fuel quantity is metered in instead of the mixture, the metering arrangement is the injection arrangement and the valve means are, for example, implemented by controllable needle valves which meter the fuel quantity.

In a refinement of the regulation, the adjustment of the stroke duration of the valve means can additionally be performed as a function of further operating parameters 8, such as, for example, engine temperature T, ambient pressure p, engine speed n and engine load M, which are processed in the regulating electronics 5. The regulating electronics 5 are of conventional design.

Figure 2:
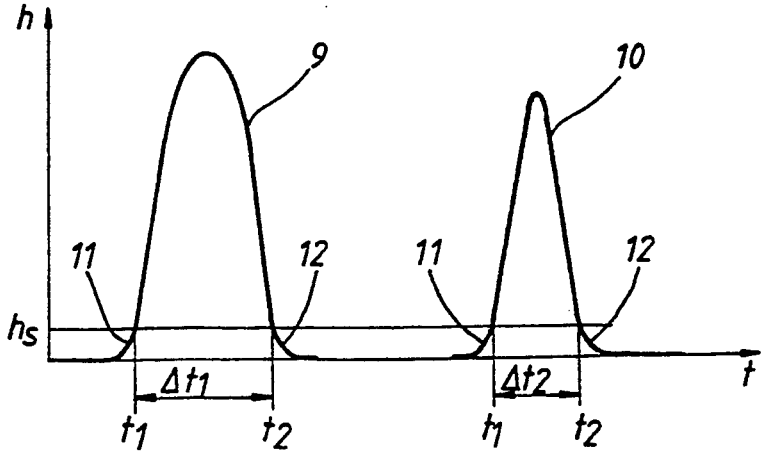
FIG. 2 shows a valve-stroke characteristic of two cylinders of the internal combustion engine as a function of time according to the method of the present invention.

FIG. 2 shows the stroke h against time t, using as examples two inlet valves of the internal combustion engine. As described above, a position sensor is arranged at each valve. If the valve stroke h of the stroke characteristic 9 of the first valve overshoots a particular threshold value $h_s$, the position sensor outputs a time signal $t_1$ to the regulating electronics 5. Upon closure of the valve, the stroke h again passes through the threshold value $h_s$ and again outputs a signal ($t_2$) to the regulating electronics 5. For exact determination of the stroke duration, the threshold value $h_s$ is placed as low as possible; a value just above the run-up ramp 11 in the stroke characteristic, as depicted in FIG. 2, has proven to be an advantageous value here.

From the two signals $t_1$ and $t_2$, the time difference $\Delta t_1$ for the stroke duration of the first valve is calculated in the regulating electronics 5. Since the stroke shape exhibits only very small deviations and only the instants for the opening and closure exhibit scatter (due to scatter in materials and to temperature and pressure effects), the time duration $\Delta t_1$ and thus the stroke duration is a sufficiently accurate measure of the filling of the cylinder.

Depicted in FIG. 2 at a later instant in time is a further stroke characteristic 10 of a second valve of the internal combustion engine. Here too, in analogous fashion to the method described above, the instants $t_1$ and $t_2$ at which the stroke h passes through the threshold value $h_s$ are measured and a time difference $\Delta t_2$ determined therefrom in the regulating electronics 5. The values for the differences $\Delta t_1$, $\Delta t_2$ and further difference values for the remaining cylinders of the internal combustion engine are generally different. However, in the regulating electronics 5 a uniform value for the stroke duration can be determined, if appropriate as a function of further operating parameters, which is output to the actuating elements for the valve means, for example electromagnetically controllable valves. In this way it is possible to achieve uniform filling of the cylinders via the individually controllable valves, even in the particularly critical idling range.

Figure 3:
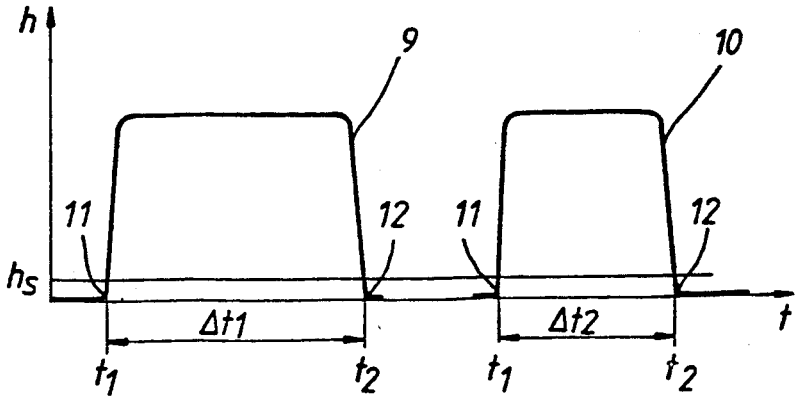
FIG. 3 shows the stroke characteristic of a valve means of a diesel injection as a function of time according to the method of the present invention.

The above statements apply analogously to the stroke characteristics 9 and 10 depicted in FIG. 3. In contrast to FIG. 2, however, it is the characteristic of the needle stroke for an electronic diesel injection for two cylinders of an internal combustion engine which is depicted here, not the stroke characteristic of the inlet valves. By means of the different stroke characteristic with different run-up ramps 11 it was also possible in this case to place the stroke threshold value $h_s$ correspondingly lower. Since the engine concerned here is an air-compressing internal combustion engine, the stroke duration $\Delta t_1$ and $\Delta t_2$ etc. is the fuel quantity to be metered in. Here too, it is possible by means of the regulating method according to the invention, as already demonstrated using the mixture-compressing internal combustion engine in FIG. 2 as an example, to adjust the variable (in this case, the fuel injection quantity) to be metered in to a uniform value for all the cylinders. It is likewise possible for further operating parameters to be used for purposes of regulation here too.

According to the present invention, the determination of the filling of the cylinder or the fuel quantity by means of position sensors and evaluation of the stroke duration instead of a pure stroke measurement with subsequent evaluation by integration with respect to time over the stroke characteristic is both highly accurate and particularly favorable in terms of cost since such sensors are already widely used, for example as sensors for determining the angular position of the crank. The regulating accuracy of the method is thereby also increased correspondingly.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Method for regulating the mixture or fuel quantity fed to cylinders of an internal combustion engine that has an arrangement for the variable metering of the mixture or fuel quantity to the cylinders of the internal combustion engine, means of measuring a stroke of valve means that are arranged movably in the metering arrangement, and an arrangement for regulating the valve movement, comprising:

measuring a stroke of the valve means allocated to each cylinder to acquire an actual value of the mixture or fuel quantity fed in;

determining a stroke duration of the valve means allocated to each cylinder; and regulating the stroke duration to an identical value for all valve means.

2. Method according to claim 1, wherein the step of determining the stroke duration includes determining a time difference from overshooting of a predetermined stroke threshold value for the stroke of the valve means to undershooting of the predetermined stroke threshold value of the valve means.

3. Method according to claim 2, wherein the predetermined stroke threshold value lies in a stroke range above a run-up ramp of a stroke characteristic of the valve means.

4. Method according to claim 3, wherein the stroke duration is regulated as a function of engine operating parameters.

5. Method according to claim 6, wherein the stroke duration is regulated as a function of engine operating parameters.

6. Method according to claim wherein the stroke duration is regulated as a function of engine operating parameters.

7. A device for regulating the mixture or fuel quantity fed to cylinders of an internal combustion engine, comprising:

a metering arrangement for the variable metering of the mixture or fuel quantity to the cylinders of the internal combustion engine;

valve means arranged movably in the metering arrangement;

means for measuring a stroke of the valve means allocated to each cylinder to acquire an actual value of the mixture or fuel quantity fed in;

an arrangement for regulating the movement of the valve means;

means for determining a stroke duration of the valve means allocated to each cylinder; and means for regulating the stroke duration to an identical value for all valve means;

wherein the means for measuring a stroke of the valve means includes a position sensor for each valve means, said position sensor providing as an output to the means for determining a stroke duration a signal when a stroke of the valve means is overshot or undershot.

* * * * *